United States Patent [19]

Nakamura et al.

[11] 4,407,940

[45] Oct. 4, 1983

[54] SILVER HALIDE COLOR PHOTOGRAPHIC MATERIAL

[75] Inventors: Shinichi Nakamura, Tokyo; Takashi Kadowaki, Odawara; Mitsuhiro Okumura, Odawara; Syun Takada, Odawara, all of Japan

[73] Assignee: Konishiroku Photo Industry Co., Ltd., Tokyo, Japan

[21] Appl. No.: 408,487

[22] Filed: Aug. 16, 1982

[30] Foreign Application Priority Data

Aug. 24, 1981 [JP] Japan ..... 56-133202

[51] Int. Cl.[3] ..... G03C 1/10

[52] U.S. Cl. ..... 430/546; 430/551; 430/567

[58] Field of Search ..... 430/551, 607, 372, 564, 430/567, 542, 543, 546

[56] References Cited

U.S. PATENT DOCUMENTS

| | | | |
|---|---|---|---|
| 4,193,802 | 3/1980 | Mukunoki et al. | 430/607 |
| 4,228,235 | 10/1980 | Okonogi et al. | 430/551 |
| 4,252,893 | 2/1981 | Iwamuro et al. | 430/551 |
| 4,308,328 | 12/1981 | Salyer et al. | 430/551 |

*Primary Examiner*—Mary F. Downey

*Attorney, Agent, or Firm*—Frishauf, Holtz, Goodman & Woodward

[57] ABSTRACT

A silver halide color photographic material which comprises a support, a silver halide emulsion layer provided thereon and a layer provided contiguous to said silver halide emulsion layer, said silver halide emulsion layer containing silver halide crystals of which average crystal size is not greater than 0.9 microns and at least 95% by number of total crystals have crystal sizes falling within ±40% said average crystal size, and said silver halide emulsion layer and/or said layer contiguous thereto containing a compound represented by the following general formula [I]

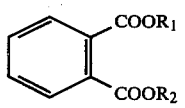

[I]

where $R_1$ and $R_2$ independently represent an alkyl group having 6 to 12 carbon atoms.

3 Claims, No Drawings

SILVER HALIDE COLOR PHOTOGRAPHIC MATERIAL

The present invention relates to a silver halide color photographic material, and particularly to a photographic material that exhibits an improved performance in the gradation of dye image.

Generally, it is well-known that a silver halide color photographic material that develops a dye image when silver halide crystals are exposed to an image pattern of light are processed by an aromatic primary amine developing agent and the oxidized form of such developing agent thereby formed undergoes a coupling reaction with a coupler or couplers.

In the process of developing a dye image as mentioned above, ordinarily, the yellow dye image is formed with use of a yellow coupler whose molecule contains an active methylene group in its open chain, while the magenta dye image is formed with use of a magenta coupler whose molecule contains an active cyclic methylene group. Familiar examples of the nucleus that carries the aforementioned active cyclic methylene group are the pyrazolone nucleus, pyrazolinobenzimidazole nucleus, indazolone nucleus, pyrazolotriazole nucleus, etc. Further, it is known that both the yellow and magenta dye images as obtained by the above coupling reaction belong to the azomethine dye group.

On the other hand, the cyan dye image is formed using a phenol or α-naphthol compound as the cyan coupler. In this case, the dye image obtained by the above coupling reaction belongs to the indoaniline dye group.

To improve the dye image, which is obtained by forming an azomethine dye or indoaniline dye as mentioned above with use of a silver halide color photographic material, in tone reproduction to an ideal form from viewpoint of practical need, various measures must be devised such as, for example, the preparing method of the silver halide emulsion.

Namely, it is described that silver halide crystals can be prepared by the reaction of a soluble silver salt and soluble halide salt through the acid process, neutral process, or ammonia process in P. Glafkides, "Chimie et Physique Photographique" (Paul Mantel, inc., 1907), G. F. Duffin, "Photographic Emulsion Chemistry" (The Focal Press, 1966), V. L. Zerickmann et al, "Making Photographic Emulsion" (The Focal Press, 1964), etc. It was also described that use of the double jet method in preparing the emulsion gives narrow crystal size distribution and thereby gives a hard contrast to the tone of photographic images as compared to the sequential mixing method. In color photography that aims at the formation of positive color images, however, the degree of hard contrast in the images as achieved above is not yet satisfactory and a method of preparing a silver halide emulsion that gives a still harder contrast to the images is desirable.

It was disclosed in the U.S. Pat. No. 2,421,292 that the method of conversion as described therein for prepare silver halide gives silver halide crystals larger crystal sizes and narrow distribution and makes it possible to produce an image of harder contrast.

Further, a method to prepare silver halide crystals having a narrow crystal size distribution is known, which uses the so-called "controlled double jet method"; a method that changes the added amount of water-soluble silver salt and water-soluble halide during the growth of silver halide crystals in the precipitation process. This method can give remarkably narrow size distribution, making it possible to obtain images of very high contrast. According to a method of preparation like this, an image of desirable gradation can be obtained without being required to use an excess amount of silver halide so that the gradation of silver halide photographic material can be efficiently controlled with use of a smaller amount of silver halide.

With the photographic material containing silver halide crystals prepared by the method as mentioned above, however, there is a tendency that the image is given a high contrast in the entire density range. In view of the nature of human vision that differentiates finer density differences in the highlighted region of image, it becomes necessary to moderate the gradation in this highlighted region. This also applies, among others, particularly to the positive light-sensitive color photographic materials. For example, an unbalance of gradation between three color layers will lead to an undesirable color image of uneven color balance.

On the one hand, methods to control the tone in the highlighted region in the positive color photosensitive material have already been disclosed. However, among the mixing methods for the preparation of silver halides as mentioned above, for example, the sequential mixing method has a drawback that soft contrast prevails in the entire range of characteristic curve up to its shoulder. Further, the so-called "auxiliary emulsion method" is known, which mixes the emulsion of narrow crystal size distribution that is obtained by the aforementioned controlled double jet method with silver halide grains primarily having such crystal sizes that the gradation in the highlighted region may be adjusted properly. This method is capable of freely controlling any gradation behavior by changing the type and amount of auxiliary emulsion, but it has an important practical difficulty that it requires preparation of a small volume of additional emulsion, which means additional labor in the production process.

Beside, in case of color photosensitive material, couplers are used, when the gradation changes as their kinds and substituents and, even if the kinds and substituents of these couplers coupld be selected properly, there are variations not only in the shoulder and straight line region of the characteristic curve but also in the color tone, making the practical application difficult.

Accordingly, it is an object of the present invention to provide a silver halide color photographic material having improved gradation of color image.

It is another object of the present invention to provide a positive color photographic material that is endowed with a visually desirable behavior of gradation in the highlighted region.

The above objects can be achieved by a silver halide color photographic material which comprises a support, a silver halide emulsion layer provided thereon, and a layer provided contiguous to said silver halide emulsion layer, said silver halide emulsion layer containing silver halide crystals of which the average crystal size is not greater than 0.9 microns and at least 95% by number of total crystals have crystal sizes falling within ±40% said average crystal size, and said silver halide emulsion layer and/or said layer contiguous thereto contains a compound represented by the general formula (I) as follows:

Formula (I)

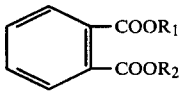

where each of $R_1$ and $R_2$ independently represent an alkyl group having 6 to 12 carbon atoms.

Namely, according to the present invention, silver halide emulsion layers, each containing silver halide crystals of average crystal size not larger than 0.9μ and of narrow size distribution, and/or another layers contiguous thereto contains a phthalic acid ester or esters as expressed by the above general formula to make it possible to prepare a color photographic material capable of giving a dye image of high contrast having desirable gradation in the highlighted region.

The above and other objects, features and advantages of the invention will become more apparent upon a reading of the following detailed specification and examples.

First, the photographic material of the present invention uses silver halide of average crystal size not larger than 0.9μ. More specifically, this average crystal size is selected in a range from 0.2 to 0.9μ, and preferably in the most effective range from 0.25 to 0.7μ. Namely, for an average crystal size not larger than 0.2μ, the material is endowed with a sensitivity too low for practical applications, while above 0.9μ, the gradation at the toe of characteristic curve shows almost no soft contrast, so with any average crystal size beyond the specified range the objects of the present invention are no more satisified.

Silver halide crystals used in the present invention not only have an average crystal size in the range as specified above but a patter of crystal size distribution such that not less than 95% of silver halide crystals are distributed within ±40% of the average crystal size.

A method to prepare silver halide crystals distributed in such narrow range is, as mentioned above, the controlled double jet method, the general description being given, for example, in "Shashin Kogaku No Kiso", p. 158, Corona Press, 1979 and more concrete descriptions being given, for example, in the Japanese Patent Publication No. 42738/1980, Japanese Patent Publication Open to Public Inspection Nos. 158220/1979, 124139/1980, 142329/1980 and 30122/1981, West German Pat. No. 2,921,164, etc. Further, a measuring method of silver halide crystal sizes is disclosed, for example, in Japanese Patent Publication No. 5981/1981.

The composition of the silver halide used in the present invention may be, for example, any of silver bromide, silver iodobromide, silver bromochloride, silver iodide, silver iodobromochloride, etc. without any particular restriction.

Next, the substituents $R_1$ and $R_2$ of the compound used in the present invention and expressed by the general formula (I), which are alkyl groups comprising 6 to 12 carbon atoms and preferably 8 or 9 carbon atoms, may be individually of straight or branched chain. And they may be substituted with substituents which do not deteriorate the effect of the present invention. According to the present invention, an alkyl group of 5 carbon atoms or less is not effective in softening the contrast in the highlighted region while an alkyl group comprising 13 carbon atoms or more lowers the performance of compound in its stable dispersion in the emulsion layer.

Examples of the compounds used in the present invention and expressed by the general formula (I) are given below. Examples of compounds:

(1) Di-n-hexyl phthalate;
(2) Di-n-heptyl phthalate;
(3) Di-n-octyl phthalate;
(4) Di-n-nonyl phthalate;
(5) Di-t-octyl phthalate;
(6) n-hexyl-n-octyl phthalate;
(7) Di-n-decyl phthalate; and
(8) Di-n-dodecyl phthalate.

The above examples generally belong to a group of compounds that are known, for example, as dispersion solvents of couplers. However, particular compounds with alkyl substituents of 6 to 12 carbon atoms having merits as insisted by the present invention have not been used so often for the dispersion solvent and, therefore, it was quite beyond expectation that when used with silver halide crystals of narrow crystal size distribution as mentioned above these compounds have an effect to soften the contrast only in the highlighted region of the silver halide emulsion. Noting this point, the present authors have succeeded in an improvement in softening the hard contrast in the highlighted region of the positive silver halide color photographic material.

According to the present invention, the above compounds can be used independently from or in combination with one another. Further, they can serve as the dispersion solvent of couplers independently from or in combination with other known solvents of low or high boiling point. When used as the dispersion solvent of couplers and additives, these compounds are used in various quantities depending on the kind and quantity of couplers or additives. For example, the weight ratio of this kind of solvent to the coupler dissolved therein is in a range from 1/5 to 5 and preferably from ½ to 2. Namely, with a smaller ratio than the above range there is no effect, while a larger ratio impairs the physical properties of the film of photographic material.

The photographic material of the present invention can use couplers as applied to the ordinary color photographic material. For the formation of yellow dye image, for example, there is the benzoylacetoanilide or pivaloylacetoanilide yellow coupler or two equivalent yellow coupler in the molecule of which the carbon atom at the coupling site has a substituent so-called "split-off" group that can be released at the time of coupling reaction. Representative examples of these yellow couplers are listed below.

Benzoylacetoanilide yellow coupler:

Ex-1

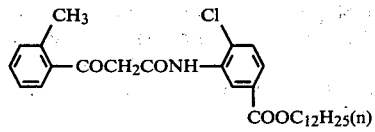

Ex-2

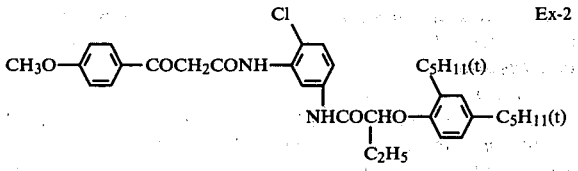

Pivaloylacetoanilide yellow coupler:

-continued

Ex-3

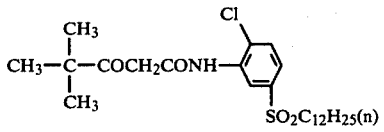

Ex-4

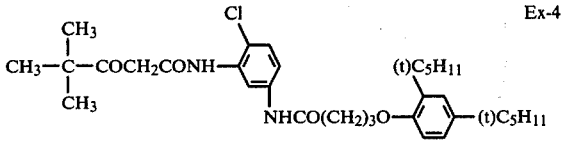

Two equivalent yellow coupler:

Ex-5

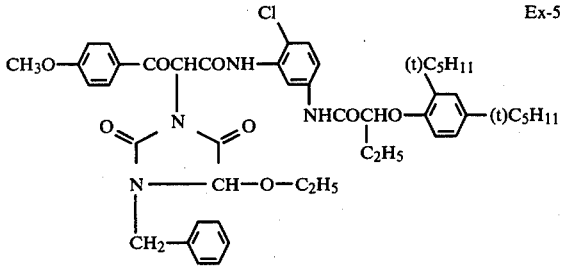

-continued

Ex-6

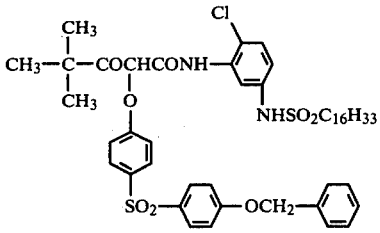

Ex-7

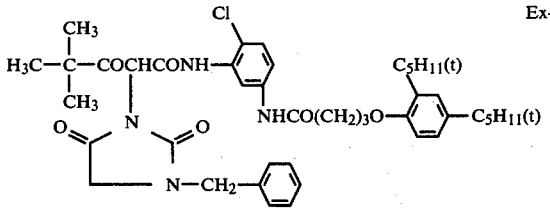

On the other hand, for the formation of magneta dye image, there are 5-pyrazolone, pyrazolitriazole, pyrazolinobenzimidazole, indazolone magenta couplers and two equivalent magenta coupler whose molecule has a substituent split-off group. Representative examples of these magenta couplers are listed below.

Pyrazolone coupler:

Ex-8

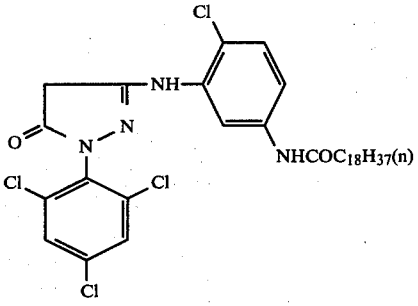

Ex-9

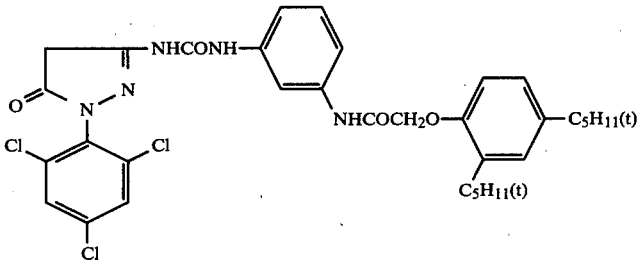

Ex-10

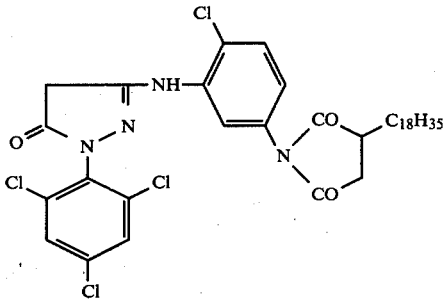

Two equivalent magenta coupler:

-continued

Ex-11

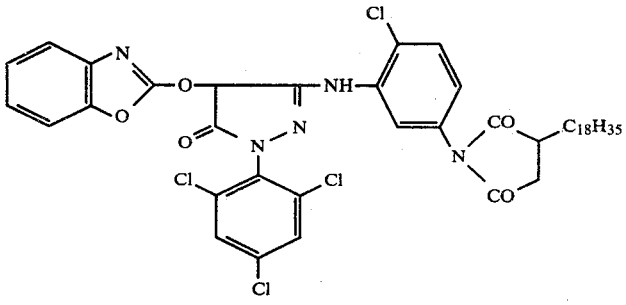

Ex-12

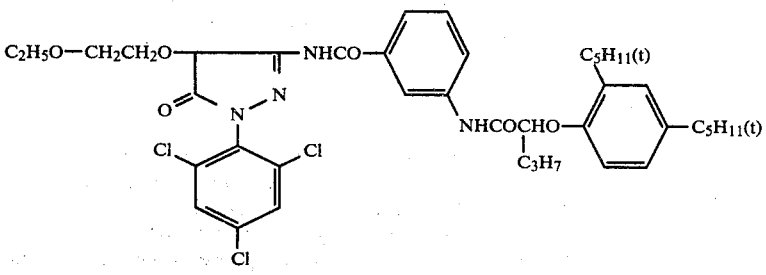

Next, for the formation of cyan dye image in the present invention, there are used phenol, naphthol, pyrazoloquinazolone cyan couplers and two equivalent cyan coupler whose molecule has a split-off group. Representative examples of these cyan couplers are listed below.

Phenol cyan coupler:

Ex-13

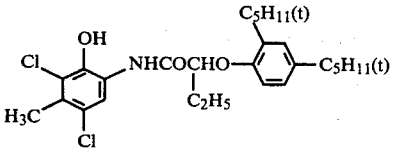

Ex-14

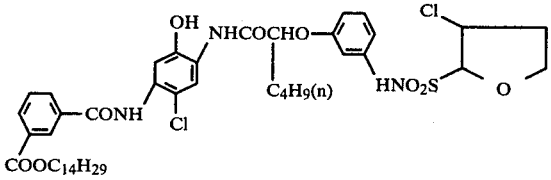

Naphthol cyan coupler:

Ex-15

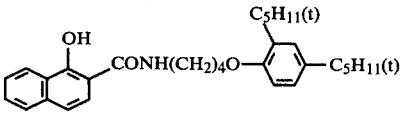

Two equivalent cyan coupler:

Ex-16

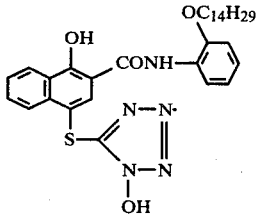

-continued

Ex-17

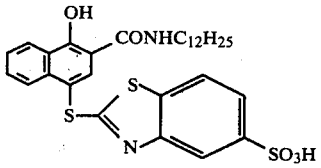

Various couplers as cited above can be added to constituent layers of the photographic material of present invention for use as couplers in emulsion type that are applied by dissolving in a solvent comprising a high boiling point solvent, such as dioctyl butyl phosphate, tributyl phosphate, tricresyl phosphate, dibutyl phthalate, diethyllaurylamide, or 1,4-dicyclohexylmethyl-2-ethyl-hexanoate, and/or an auxiliary solvent of low boiling point, such as ethyl acetate, methanol, acetone, or tetrahydrofuran.

Besides photosensitive emulsion layers containing the aforementioned silver halide crystals of narrow crystal size distribution as related to the present invention, the photographic material of the present invention can be provided with various interlayers and/or auxiliary layers as its constituent layers depending on the particular purpose.

The layer provided contiguous to the silver halide emulsion layer of the present invention may be either a non-photosensitive or a photosensitive silver halide emulsion layer, and preferably it is a non-photosensitive gelatin layer.

For the hydrophilic binder of the constituent layers of the above photographic material, such as emulsion layers, interlayers, filter layers, backing layer, and protective layer; besides gelatin, its proper derivatives can be used depending on the purpose. Examples of these proper gelatin derivatives are acylated gelatin, guanizylated gelatin, carbamylated gelatin, cyanoethanol-treated gelatin, and esterified gelatin. Further, depending on the purpose, any other hydrophilic binder of conventional type can be added and further the hydrophilic binder formulation as mentioned above can contain plasticizer, lubricant, etc.

Besides the photographic material of the present invention can be loaded in the above photosensitive emulsion layers and/or other constituent layers thereof with various additives for photography depending on the purpose. These photographic additives include, for example, stabilizer, sensitizer, film's physical property improving agent, hardener, spreading agent, coupler solvent, so-called "DIR compound" or development inhibitor releasing agent capable of releasing a development inhibitor while forming a practically colorless compound at the time of processing for color development, as well as antistatic agent, defoaming agent, ultraviolet ray absorbing agent, fluorescent whitening dye, anti-slip agent, matting agent, antihalation agent, anti-irradiation agent, etc. These various photographic additives can be used independently or in combination.

Among the above additives, the stabilizer is used to prevent fogging during the production process, storage, or development processing of photographic material and also to stabilize the photographic performances thereof. Examples of such stabilizer are nitrobenzimidazole, mercaptobenzthiazole, aminotriazole, mercaptotetrazole, triazaindenes, tetrazaindenes, and benzenesulfinic acid, all of which are known compounds.

Among the above additives, the sensitizer can be added to increase the sensitivity of photographic material and improve the contrast. Examples of such sensitizer are various polyalkylene oxide compounds, thioethers, thiomorpholines, derivatives of urea, and 3-pyrazolidones.

For the photographic material of the present invention, beside the above sensitizer, various spectral sensitizers are preferably used for spectral sensitization. Spectral sensitizers used for this purpose are cyanine dye, merocyanine dye, hemicyanine dye, styryl dye, and hemioxanol dye, among which the first two dyes are particularly useful. These sensitizing dyes can be used independently or in combination.

Particularly, examples of these sensitizing dyes the color photographic material contains are, for example, disclosed in detail in U.S. Pat. Nos. 2,526,632, 2,503,776, 2,493,748, 3,384,486, 3,480,434, 3,573,916, and 3,582,338. In addition, it is generally well-known that a spreading agent is used to improve the coating performance of the emulsion, for example, when the emulsion film is formed by coating in the production process and that various polymer compounds are added as film's physical property improving agents to improve the physical properties of film.

Further, the above constituent layers of photographic material can be hardened by addition of a suitable hardener. Examples of such hardener are chromium salts, zirconium salts, aldehyde hardeners such as formaldehyde and mucohalogeno acid, and halotriazine, polyepoxy, ethyleneimine, vinylsulfone and acryloyl hardeners.

As already mentioned, beside the above, many other additives can be used to improve the electric, optical, and physical characteristic properties of the photographic material.

The silver halide color photographic material of the present invention as constituted above can comprise a support. Representative examples of the support are polyethylene terephthalate film, polycarbonate film, polystyrene film, polypropylene film, cellulose acetate film, glass, Baryta paper, polyethylene laminate paper, etc., subbed as necessary.

The color developing solution used in processing the color photographic material of the present invention is an alkaline aqueous solution of pH value not less than 8, and preferably between 9 and 12 that contains a color developing agent. As such developing agent, an aromatic primary amine with a substituent primary amine group on its aromatic nucleus is used which is either a compound capable of processing silver halide that has been exposed to light for development or its precursor capable of forming such compound.

Representative of the above developing agent are p-phenylenediamine compounds, examples of which are cited below.

4-amino-N,N-diethylaniline, 3-methyl-4-amino-N,N-diethylaniline, 4-amino-N-ethyl-N-(β-hydroxyethylaniline, 3-methyl-4-amino-N-ethyl-N-β-hydroxyethylaniline, 3-methyl-4-amino-N-ethyl-N-β-methanesulfonamidoethylaniline, 3-methyl-4-amino-N-ethyl-N-β-methoxyethyl-4-amino-N,N-diethylaniline, 3-methoxy-4-amino-N-ethyl-N-β-hydroxyethylaniline, 3-methoxy-4-amino-N-ethyl-N-β-methoxyethylaniline, 3-acetamido-4-amino-N,N-diethylaniline, 4-amino-N,N-dimethylaniline, N-ethyl-N-β-[β-(β-methoxyethoxy)ethoxy]ethyl-3-methyl-4-aminoaniline, N-ethyl-N-β-(β-methoxyethoxy)ethyl-3-methyl-4-aminoaniline and their salts including sulfate, chloride, sulfite, p-toluenesulfonate. Further, the above color developing solution can be loaded with various additives as necessary.

After the imagewise exposure and processing for color development, the color photographic material of the present invention can be bleached by the ordinary method. This bleaching can be performed independently from fixing or simultaneously therewith and, therefore, the bleaching solution for this purpose can be provided in form of a bleach-fix bath by adding a fixing agent. For the bleaching agent, various compounds can be used and the bleach accelerator and various other additives can be added.

Additives that can be added to the above color developing solution are, for example, a pH buffer agent such as carbonate, borate or phosphate, inorganic or organic antifogging agent, organic solvent such as benzyl alcohol or diethylene glycol, preservative such as hydroxylamine, and development accelerator such as polyethylene glycol.

The invention will be more clearly understood with reference to the following Examples.

EXAMPLE 1

A silver bromochloride emulsion containing 10 mol percent of silver chloride was prepared by the conventional double jet mixing method. The prepared emulsion had an average crystal size of 0.3μ and did not satisfied the condition that not less than 95% of existing crystals were within ±40% of the average crystal size. After washing, this emulsion underwent the sulfur sensitization by usual method and further, after chemical aging, it was loaded with a sensitizing dye anhydro-2-[3-(3-ethyl-5,6-dimethoxybenzothiazolin-2-ylidene)methyl-5,5-dimethyl-2-cyclohexen-1-ylidene]methyl-3-(3-sulfopropyl)benzothiazolium hydroxide for spectral sensitization. Further, a stabilizer 4-hydroxy-6-methyl-1,3,3a,7-tetrazaindene was added to provide an emulsion sample E-1.

Next, a silver bromochloride emulsion containing 10 mol percent of silver chloride was prepared by a method as described by Japanese Patent O.P.I. Publication No. 11386/1972 for use as another emulsion sample E-2. This emulsion had an average crystal size of 0.3μ with not less than 95% of the whole crystals being within ±40% of the average crystal size.

On the one hand, 100 g of cyan coupler 2,4-dichloro-3-methyl-6-[α-(2,4-di-t-amylphenoxy)butylamido]-phenol and 2.0 g of color antistaining agent 2,5-di-t-octylhydroquinone were dissolved in a mixture of 50 ml of high boiling point solvent di-n-butyl phthalate and 150 ml of auxiliary low boiling point solvent ethyl acetate. The solution was then mixed with 3,000 ml of 5% gelatin solution containing 10 g of sodium dodecylbenzenesulfonate as activator and the mixture was agitated vigorously in a homomixer for full dispersion of the cyan coupler. The homogenized solution was heated to evaporate the low boiling point solvent. A coupler predispersed solution C-1 was thus prepared.

In the above process of preparing the coupler predispersed solution C-1, di-n-nonyl phthalate was used instead of di-n-butyl phthalate to prepare another coupler predispersed solution C-2. Each of these solutions C-1 and C-2 was added to a volume of the above emulsion E-1 containing 1 mol of silver halide. Further, a hardener bis(vinylsulfonylmethyl)-ether was added to a concentration of 10 mg/m$^3$. After addition of a coating aid saponine, the emulsion was coated onto support of polyethylene-coated paper and dried to form a gelatin coating of 1.0 g gelatin/m$^3$ of base.

The above film sample was exposed to light through an optical wedge with use of a sensitometer and then processed according to the following processing condition to develop a cyan dye image:

| | | |
|---|---|---|
| [Processing step, temperature, time] | | |
| Color development | 33° C. | 3½ min |
| Bleach-fixing | 33° C. | 1½ min |
| Washing | 33° C. | 1 min |
| Drying | 30 to 120°C. | |
| [Formulation of color developing solution] | | |
| Benzyl alcohol | | 15 ml |
| Ethylene glycol | | 15 ml |
| Whitex BB (50% solution, brand name of whitening dye supplied by Sumitomo Chemical Co., Ltd.) | | 2 ml |
| Hydroxylamine sulfate | | 3 g |
| 3-methyl-4-amino-N—ethyl-N—(β-methanesulfonamidoethyl) aniline sulfate | | 4.5 g |
| p-toluenesulfonic acid | | 10.0 g |
| Potassium carbonate | | 30 g |
| Potassium sulfite | | 2 g |
| Potassium bromide | | 0.5 g |
| Potassium chloride | | 0.5 g |
| 1-hydroxyethylidene 1,1-diphosphonic acid (60% aqueous solution) | | 2 ml |
| Water was added to make up for 1 liter with sulfuric acid or potassium hydroxide solution added to adjust the pH to 10.2 | | |
| [Formulation of bleach-fixing bath] | | |
| Ethylenediaminetetraacetic acid | | 40 g |
| Ammonium sulfite (40% solution) | | 35 ml |
| Ammonium thiosulfate (70% solution) | | 135 ml |
| Ethylenedieminetetraacetic acid ferric sodium salt | | 70 g |
| Ammonia water (28% solution) | | 35 ml |
| Water was added to make up for 1 liter with ammonia water or glacial acetic acid added to adjust the pH to 7. | | |

The reflection density of the cyan dye image formed in each sample was measured by Sakura Color Densitometer Model PDA-60 (manufacturer: Konishiroku Photo Industry Co., Ltd.) using a red filter. The results are given in the following table:

TABLE 1

| Sample No. | Test emulsion | Coupler predis. soln | Gradient Straight line | Gradient Toe |
|---|---|---|---|---|
| 1 | E-1 | C-1 | 2.24 | 1.87 |
| 2 | E-1 | C-2 | 2.31 | 1.90 |
| 3 | E-2 | C-1 | 3.12 | 2.36 |
| 4 | E-2 | C-2 | 3.09 | 2.01. |

In the above table, the gradient at the straight line region and the one at the toe were the contrast of color image as estimated by an expression ΔD/Δlog E in the density range from 0.5 to 1.5 and in the density range from 0.2 to 0.5, respectively.

Sample Nos. 1 and 2 were not embodiments of the present invention. The gradation in their straight line region indicated a contrast too soft for practical use as the color photographic material. Further, these two samples did not differ in the gradient at the toe in spite of a difference between them in the kind of phthalic acid ester used as the high boiling point solvent of coupler predispersed solution. Sample No. 3 made use of a silver halide emulsion prepared by a method as related to the present invention but the solvent used for the coupler predispersed solution did not conform to the present invention. It showed unpreferably a hard contrast at the toe.

On the other hand, Sample No. 4 embodying the present invention showed preferable gradation with a hard contrast at the straight line region and a soft contrast at the toe.

EXAMPLE 2

The same method as in Example 1 was used to prepare a silver bromochloride emulsion containing 2.0 mol percent of silver chloride. In this case, however, the mixing condition was so controlled that the emulsion had an average crystal size of 0.4μ and narrow crystal size distribution as indicated by the standard deviation of crystal sizes a=0.15. With addition of magnesium sulfate solution, the above emulsion was desalted and washed. The emulsion then underwent sulfur sensitization followed by chemical aging. A green sensitizing dye anhydro-5,5'-diphenyl-9-ethyl-3,3'-(di-t-sulfopropyl)-oxacarbocyanin hydroxide was then added to the emulsion. Further, 4-hydroxy-6-methyl-1,3,3a,7-tetrazaindene was added to provide a green sensitive emulsion E-3.

On the other hand, 100 g of a magenta coupler 1-(2,4,6-trichlorophenyl)-3-(2-chloro-5-octadecenylsuccinimidoanilino)-5-pyrazolone was dissolved in a mixture of 100 ml of high boiling point solvent tri-o-cresyl phosphate and 300 ml of auxiliary low boiling point solvent butyl acetate. The solution was added to 1,000 ml of aqueous 5% gelatin solution containing 7 g of sodium alkylnaphthalenesulfonate (Alkanol B) and the mixture was homogenized by an ultrasonic homogenizer for dispersion to give a coupler predispersed solution M-1.

Beside, a compound of the present invention, namely, di-n-octyl phthalate (compound Ex-3) was used instead of the above high boiling point solvent to prepare a coupler predispersed solution M-2.

Each of these solutions M-1 and M-2 was mixed with a volume of emulsion E-3 containing 1 mol of silver halide. 10 ml of 2% ethanol solution of hardener N,N',N''-triacroyl-6H-S-triazine was added to the mixture. After addition of coating aid saponine, the mixture was applied to a base of polyethylene-coated paper that had been loaded with titanium oxide and pretreated with corona discharges in a thickness equivalent to 0.3 g silver/m$^2$ of support and then dried. The above film samples were exposed and processed by the same method as in Example 1 and the density of developed color image was measured through a green filter. The results are given in the following table:

TABLE 2

| Sample No. | Test emulsion | Coupler predis. soln | Gradient | |
|---|---|---|---|---|
| | | | Straight line | Toe |
| 5 | E-3 | M-1 | 3.02 | 2.34 |
| 6 | E-3 | M-2 | 3.00 | 2.02. |

Above Sample No. 5 whose emulsion was prepared with use of a compound not covered by the present invention showed a hard contrast both in the straight line region and at the toe. By contrast, Sample No. 6 was improved in the gradation at the toe, showing a soft contrast there.

EXAMPLE 3

500 ml of 0.1 mol silver nitrate solution and 500 ml of 0.1 mol potassium bromide solution were added into 5,000 ml of 5% gelatin solution by a measuring pump in such a way that the pAg value might be maintained at 6.0. Silver bromide cubic crystals having average crystal size of 0.2$\mu$ were thus produced. According to the ordinary method, these crystals were precipitated and washed for removal of soluble salts.

Next, added to a solution containing the above silver bromide were 3,000 ml of solution containing 3 mol of silver nitrate and 3,000 ml of solution containing 3 mol of potassium bromide using a measuring pump in such a way that the pAg value may be maintained at 8.0. The precipitates were washed. There was thus produced silver bromide that had an average crystal size of 0.7$\mu$ and narrow crystal size distribution as indicated by the standard deviation of 0.2. Its emulsion underwent chemical aging under presence of a sulfur sensitizer and then it was loaded with blue sensitizing dye anhydro-5-methoxy-5'-methyl-3,3'-di(3-sulfobutyl)selenocyanine and 4-hydroxy-6-methyl-1,3,3a,7-tetrazaindene to give an emulsion sample E-4.

On the other hand, 200 g of yellow coupler $\alpha$-(1-benzyl-2,4-dioxo-3-imidazolidinyl)-$\alpha$-pivalyl-2-chloro-5-[$\gamma$-(2,4-di-t-amylphenoxy)-butylamido]acetoanilide and 1 g of color antistaining agent 2,5-di-t-octylhydroquinone were dissolved in a mixture of 100 ml of high boiling point solvent di-n-butyl phthalate and 300 ml of auxiliary solvent ethyl acetate. The solution was added to 1,000 ml of aqueous 5% gelatin solution containing 6 g of sodium dodecylbenzenesulfonate. The mixture was homogenized by a homogenizer for dispersion. The coupler predispersed sowlution Y-1 was thus prepared.

Another coupler predispersed solution Y-2 was prepared by the same method except that the high boiling point solvent di-n-octyl phthalate was used instead of di-n-butyl phthalate. Each of these two coupler predispersed solutions was mixed with the emulsion sample E-4 and applied to the base to a thickness equivalent to 0.3 g silver/m$^2$ of base using the same method as in Example 1. Film sample Nos. 7 and 8 were thus prepared. They were exposed and processed to undergo the measurement of color density through a blue filter. The results are given in the following table:

TABLE 3

| Sample No. | Test emulsion | Coupler predis. soln | Gradient | |
|---|---|---|---|---|
| | | | Straight line | Toe |
| 7 | E-4 | Y-1 | 3.54 | 2.55 |
| 8 | E-4 | Y-2 | 3.58 | 2.16. |

It is clearly understood from the above table that the film sample No. 7 that was prepared without conforming to the present invention unpreferably showed a hard contrast at the toe, while the Sample No. 8 of the present invention was found to give a soft contrast at the toe indicating an improved performance in the tone reproduction at the highlighted region.

EXAMPLE 4

Using emulsion samples E-2, E-3 and E-4 as prepared in the above Examples, a multi-layered photographic material or film sample No. 9 was prepared as follows:

| | |
|---|---|
| [Constituent layers] | |
| Support: Polyethylene laminated paper | |
| First layer, blue sensitive layer: | |
| Silver bromide emulsion (emulsion sample E-4) | |
| Applied quantity: | 350 mg silver/m$^2$ of base |
| Yellow coupler (compound Ex-7) | |
| Applied quantity: | 1,000 mg/m$^2$ |
| Di-octyl phthalate | |
| Applied quantity: | As above |
| Gelatin | |
| Applied quantity: | As above |
| Second layer, interlayer: | |
| Gelatin | |
| Applted quantity: | 500 mg/m$^2$ |
| Third layer, green sensitive layer: | |
| Silver bromochloride emulsion (emulsion sample E-3) | |
| Applied quantity: | 350 mg silver/m$^2$ |
| Magenta coupler (compound Ex-10) | |
| Applied quantity: | 350 mg/m$^2$ |
| Tricresyl phosphate: | |
| Applied quantity: | 200 mg/m$^2$ |
| Gelatin | |
| Applied quantity: | 1,000 mg/m$^2$ |
| Fourth layer, interlayer: | |
| Gelatin | |
| Applied quantity: | 1,200 mg/m$^2$ |
| Fifth layer, red sensitive layer: | |
| Silver bromochloride emulsion (emulsion sample E-2) | |
| Applied quantity: | 250 mg silver/m$^2$ |
| Cyan coupler (compound Ex-13) | |
| Applied quantity: | 400 mg/m2 |
| Di-n-butyl phthalate | |
| Applied quantity: | As above |
| Gelatin | |
| Applied quantity: | 1,500 mg |
| Sixth layer, protective gelatin layer: | |
| Gelatin | |
| Applied quantity: | 1,000 mg/m$^2$. |

Further, another film sample No. 10 was prepared, which had the same constituent layers as the film sample 9 except for the first layer for which a silver bromide emulsion prepared by the sequential mixing method and having a wider crystal size distribution was applied 400 mg silver/m$^2$ of base and di-n-butyl phthalate was used instead of dioctyl phthalate without changing the applied quantity.

The above film sample Nos. 9 and 10 were exposed through an optical wedge using a sensitometer manufactured by Konishiroku Photo Industry Co., Ltd. They were then processed for development as follows:

| | | |
|---|---|---|
| [Processing steps] | | |
| Color development | 40° C. | 3½ min |
| Bleach-fixing | 33° C. | 1½ min |
| Washing | 30° C. | 2 min |
| Drying | 80° C. | |
| [Color developing solution] | | |
| Fluorescent whitening dye (Whitex BB Conc, supplier: Sumitomo Chemical Co., Ltd.) | | 1.0 g |
| Benzyl alcohol | | 13.0 ml |
| Ethylene glycol | | 13.0 ml |
| Potassium sulfite | | 2 g |
| Hydroxylamine sulfate | | 3.5 g |
| Potassium carbonate | | 2.6 g |
| 1-hydroxyethylidene 1,1-diphosphonic acid (60% solution) | | 0.8 g |
| N—ethyl-N—β-methanesulfonamidoethyl-3-methyl-4-aminoaniline sulfate | | 4.5 g |
| 4-hydroxy-6-methyl-1,3,3a,7-tetrazaindene | | 50 mg |
| Potassium bromide | | 2.0 g |
| Magnesium chloride | | 0.5 g |
| Potassium hydroxide or potassium bicarbonate was used to adjust pH to 10.20. | | |
| [Bleach-fixing solution] | | |
| Sakura Color Paper Processing Solution Type CPK 12 was used. | | |

After processing, the film samples were subjected to measurements of the color density through a blue filter. The results are given in the following table:

TABLE 4

| | Gradient | |
|---|---|---|
| Sample No. | Straight line | Toe |
| 9 | 3.62 | 2.07 |
| 10 | 3.48 | 2.41 |

It is clearly understood from the above table that the film sample No. 9 of the present invention that had a narrower crystal size distribution as compared with the control film sample 10 that did not conform to the present invention showed a gradation of satisfactory hard contrast in straight line region and further a desirable gradation at the toe indicating a good tone reproducibility at the highlighted region. It was found from the present Example that the merits of the present invention as mentioned above can also be achieved with the multilayer photographic material.

What is claimed is:

1. A silver halide color photographic material which comprises a support, a silver halide emulsion layer provided thereon and a layer provided contiguous to said silver halide emulsion layer, said silver halide emulsion layer containing silver halide crystals of which average crystal size is not greater than 0.9 microns and at least 95% by number of total crystals have crystal sizes falling within ±40% said average crystal size, and at least one of said silver halide emulsion layer and/or said layer contiguous thereto containing a compound represented by the following general formula [I]

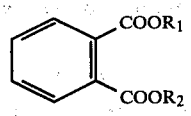

[I]

where $R_1$ and $R_2$ independently represent an alkyl group having 6 to 12 carbon atoms.

2. A silver halide color photographic material according to claim 1 wherein said alkyl group has 8 or 9 carbon atoms.

3. A silver halide color photographic material according to claim 1 wherein said layer contiguous to said silver halide emulsion layer is a non-photosensitive gelatin layer.

* * * * *